United States Patent [19]

McCall

[11] 4,090,607

[45] May 23, 1978

[54] MAILING CARTON FOR BOOKS

[76] Inventor: Richard J. McCall, 1515 N. Sedgwick St., Chicago, Ill. 60610

[21] Appl. No.: 787,484

[22] Filed: Apr. 14, 1977

[51] Int. Cl.[2] ..... B65D 5/36

[52] U.S. Cl. ..... 206/424; 229/40

[58] Field of Search ..... 229/40; 206/424, 521

[56] References Cited

U.S. PATENT DOCUMENTS

| | | | |
|---|---|---|---|
| 3,055,574 | 9/1962 | Johnson | 229/40 |
| 3,110,435 | 11/1963 | Layne, Sr. | 229/40 |
| 3,179,325 | 4/1965 | Johnson | 229/40 |
| 3,227,356 | 1/1966 | Eifrid | 229/40 X |

FOREIGN PATENT DOCUMENTS

| | | | |
|---|---|---|---|
| 2,003,388 | 1/1970 | Germany | 229/40 |

*Primary Examiner*—Stephen P. Garbe

*Attorney, Agent, or Firm*—Hill, Gross, Simpson, Van Santen, Steadman, Chiara & Simpson

[57] ABSTRACT

A mailing carton of the type having end air pockets is strengthened at each end by edges formed by multiple layers of corrugated material extending outwardly from the interior compartment and also by reinforced layers of corrugated material forming an end wall inwardly from the reinforced edges. A recess formed in the center of each multiple layered top edge facilitates utilization of an "L" shaped sealing tool for sealing the end walls of the top panel by short reinforced adhesive tape segments disposed on surfaces in right angular relationship.

8 Claims, 9 Drawing Figures

MAILING CARTON FOR BOOKS

BACKGROUND OF THE INVENTION

1. Field of the Invention

The present invention relates to a mailing carton formed from a one-piece material blank which is cut and scored for folding and sealing to transport an article such as a book.

2. The Prior Art

Protection of books and other relatively heavy but compact articles for handling through mailing systems requires that end edges of the mailing containers therefor be reinforced to absorb shocks. My prior U.S. Pat. Nos. 3,426,957, 3,712,531, and 4,006,822, exemplify the state of the art in utilizing various means for increasing the strengths of end edges of relatively shallow mailing cartons by providing air pockets or recesses and angulated members at the ends. Construction of deeper cartons for mailing thicker or greater numbers of books has required very heavy sheet materials to provide desired rigidity, with wrappings of tape to ensure security of the parcel.

SUMMARY OF THE INVENTION

In accordance with the invention, a heavy duty mailer is provided with augmented multiple layers of material at critical stress points to provide a triple layered air pocket buffer and a double layered end wall. The multiple layers are pre-notched in such a manner as to form together in register with one another a recess so that an "L" shaped sealing tool can be made to apply segments of reinforced pressure sensitive adhesive tape directly to the top and end walls disposed in right angle relationships to one another.

The carton handles with protective safety as many as six books, or an equivalent weight of fewer but larger books.

THE DRAWINGS

THE PREFERRED EMBODIMENTS

Figure 1:
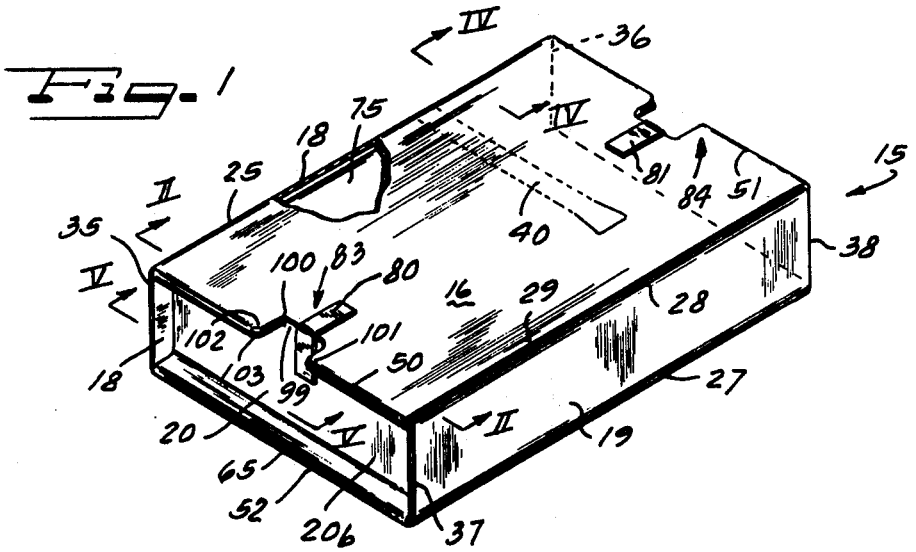
FIG. 1 is a general perspective view, partly cut away, of a mailing carton of the present invention.

A mailing carton 15 constructed in accordance with the principles of the present invention as shown in FIG. 1 in completely assembled form. The mailing carton 15 is constructed of a corrugated sheet stock material which is cut, scored, and folded from a one-piece blank more completely shown in FIG. 7 into the exterior configuration shown for mailing one or more articles such as a book 75 within a generally rectangular space formed within the carton.

Figure 7:
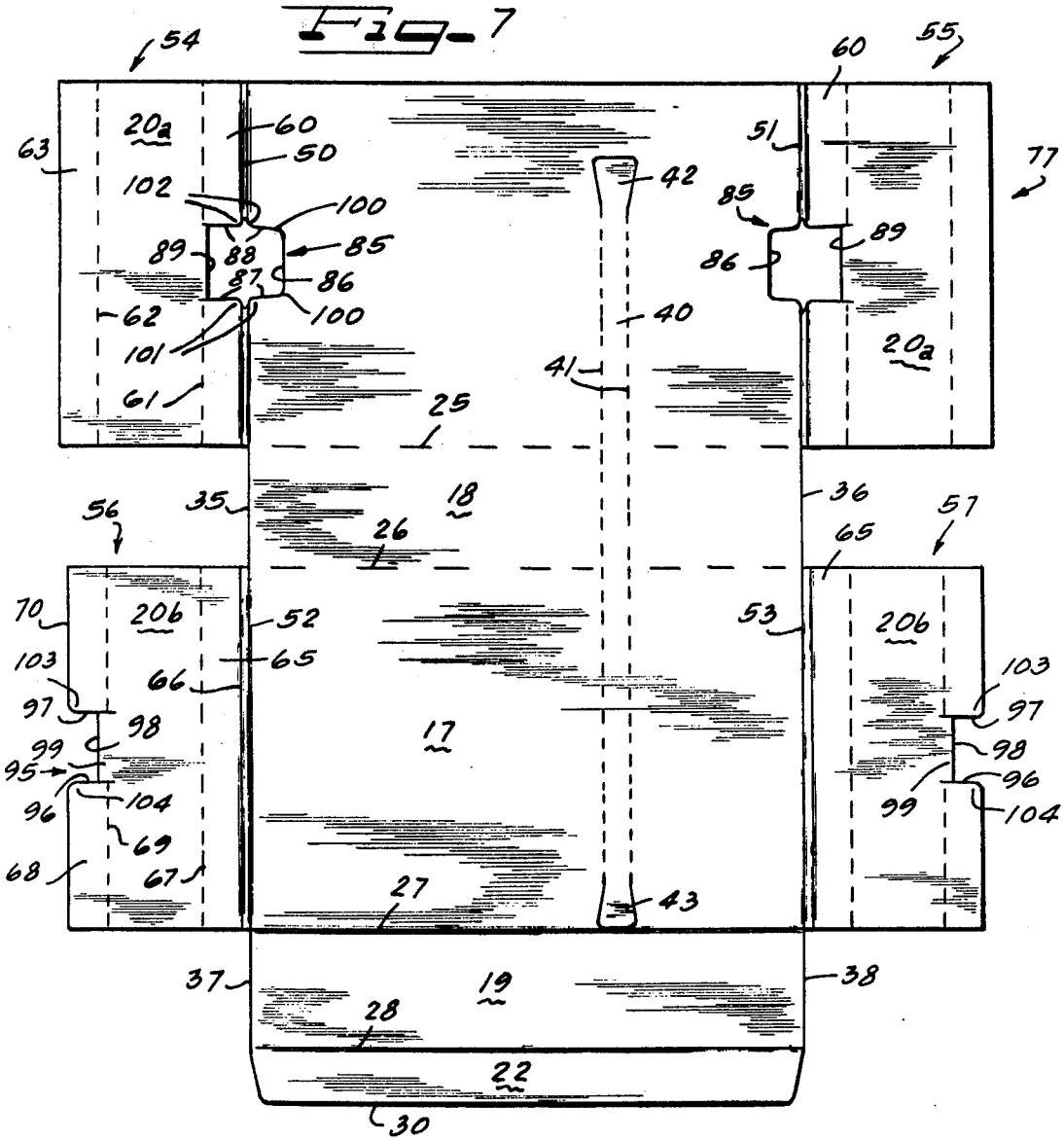
FIG. 7 is a plan view of a sheet-form blank cut and scored for assembling the mailing carton of the present invention.

Referring to FIG. 7 in conjunction with the other figures, the carton 15 comprises a top panel 16 and a bottom panel 17 which are both of the same size and shape and which are maintained in spaced parallel relation with one another. First and second side walls 18, 19 and end flaps 20, 21 complete a space enclosure as shown. A sealing tab 22 is connected to the second side wall 19 along an edge thereof for engagement as by adhesive means to an undersurface of the top panel 16 along an edge thereof.

Since the carton 15 is formed from a single piece of sheet form material, all the panels, walls, flaps, and the tab are connected together along fold lines forming edges thereof. The top panel 16 is connected to the first side panel along a first fold line 25, the first side panel 18 is connected to the bottom panel 17 by a second fold line 26 which is parallel to the fold line 25, and the bottom panel 17 is connected to the second side panel 19 by a third fold line 27. The sealing tab 22 is connected to the second side panel 19 by a further, fourth fold line 28. The top panel 16 has a free edge 29, and the tab 22 has an opposite free edge 30. Edges of the side panels 18 and 19 transverse to the fold lines 25, 26, 27 and 28, at 35, 36, 37, and 38, respectively are also free.

A tear strip 40 is formed in the top panel 16, the first side wall 18, and the bottom panel 17 by parallel perforations 41. Cut-out pull tabs 42, 43 are formed at opposite ends of the strip 40.

Each of the top and bottom panels 16, 17 has respective opposite end edges and end fold lines 50, 51 and 52, 53 transverse to the primary fold lines 25–28 and the free edges 29, 30. End flaps 54, 55; 56, 57 are foldably attached to the end edges 50–53. They are formed and folded in accordance with the invention to provide the double-thickness end walls 20, 21 as well as double-thickness reinforcement of the end edges of the panels 16, 17. Each of the end flaps 54 and 55 are identical or mirror images of one another about the top panel 16, as are the end flaps 56, 57 attached to the bottom panel 17. The flaps 54, 55 form inner end flaps and inner reinforcement members, while the end flaps 56, 57 form outer end flaps and outer reinforcement members.

Figure 3:
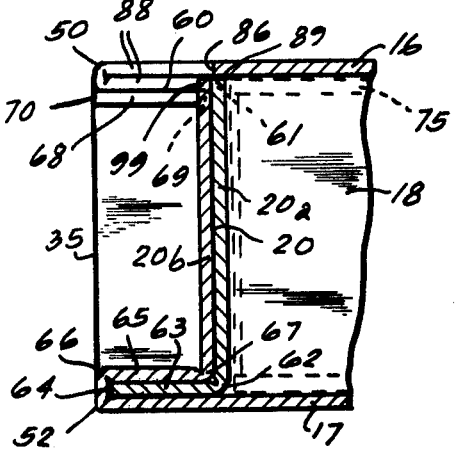
FIG. 3 is a side elevational view of the center end portion of the carton, taken on line III—III of FIG. 2.
Figure 4:
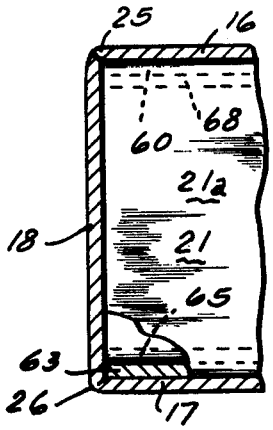
FIG. 4 is an endwise sectional view of a side portion of the mailing carton, taken on line IV—IV of FIG. 1.

The end flap 54 is comprised of a first, inner reinforcement member 60 connected to the top panel 16 at end fold line 50, with the fold line 50 adapted to orient the member 60 into a face to face abutting relationship to the lower surface of the top panel 16, as for instance in FIG. 3. The first inner reinforcement member 60 is connected to the inner end flap **20*a* by a parallel fold line 61. Opposite the reinforcement member 60, and connected to the inner end flap 20*a* by a further parallel fold line 62 is a second inner reinforcement member 63. An end edge 64 of the second reinforcement member 63** is free.

The end flaps 56, 57 connected to the bottom panel 17 are constructed similarly to the end flaps 54, 55, each comprising a first outer reinforcement member 65 connected directly to the bottom panel 17 by double fold lines 52, 66. The fold lines 52, 66 are spaced apart by a distance sufficient to accept therebetween the thickness of the second reinforcement member 63, as shown in FIG. 3. A second fold line 67 connects the first outer reinforcement member 65 to the outer end flap **20*b*. A second, outer reinforcement member 68 is connected to an upper edge of the outer end flap 20*b* along a fold line 69. An outermost edge 70 of the end flap 56 and of the second, outer reinforcement member 68**, is free and exposed in the finished carton.

The panels 16 and 17 form a main top wall panel and a main bottom wall panel while the 3-panelled end flaps 54, 55, 56 and 57 are provided at the ends of the main panels. Each end panel has a major centrally disposed end wall panel such as **20*a* or 20*b* flanked by minor inner reinforcement panels 60, 63 and minor outer reinforcement panels 65, 68**, respectively. The recessed arrangement permits use of a so-called "L" shaped sealer machine of the type manufactured by the 3M Company. Thus, reinforced tape can be placed on right angled surfaces.

Thus, in accordance with one of the principles of the invention, the interior space of the carton 15 in which the book 75 is to be shipped has three layers of protection at each end edge of the top and bottom panels. With the corrugations of the material of the carton 15 running lengthwise in the top and bottom panels, the triple thickness of material outwardly of the inner surface of the inner wall **20*a* protects the book 75 against shocks, impacts, and damage thereto. The double thickness end walls 20, 21 rigidify the deep carton and also protect the ends of the book 75** against puncture damage.

Further in accordance with the principles of the invention, the panels, walls, and flaps of the carton 15 are quickly assembled at the point of use by application of short segments of tape 80, 81 as noted, directly between the top panel 16 and the end walls 20, 21, respectively. The tape segments 80, 81 comprise a high tensile strength binding tape which may have fiber reinforcements running lengthwise thereof. The tape segments 80, 81 are conveniently applied by an automatic machine adapted for applying tape to right-angle surfaces. The carton 15 is adapted to be used with such machine by having recesses 83, 84 formed in the ends of the top panel 16 outwardly of the end walls 20, 21.

Figure 5:
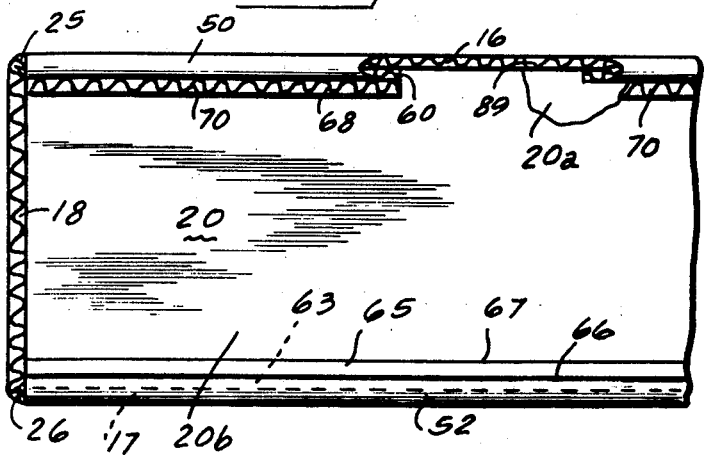
FIG. 5 is an endwise plan view of a portion of the carton of FIG. 1, taken on line V—V thereof, with a center portion of the top edge broken away.
Figure 6:
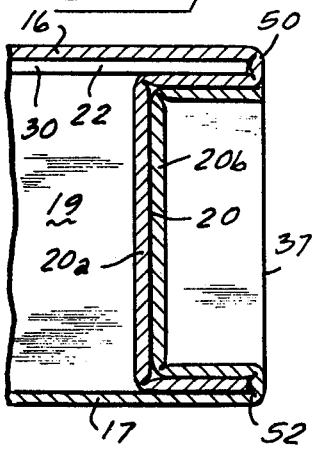
FIG. 6 is a side elevational view taken on line VI—VI of FIG. 2.

The end recesses 83, 84 are each formed in two parts as shown in the plan view of a carton blank 77 as in FIG. 7. The top panel 16 and the first, inner reinforcement member 60 have a tape aperture 85 formed therein by walls 86, 87, 88, and 89 through the corrugated stock. The wall 86 is formed parallel to the fold line 50 and is spaced inwardly therefrom to a depth slightly less than a width of the first inner reinforcement member 60. The opposite wall 89 of the tape aperture 85 is carried on the inner end flap **20*a* and is separated from the first inner reinforcement member 60 by extensions of the cuts forming the walls 87, 88. As shown in FIGS. 3 and 5, the wall 89 directly supports the center part of top panel 16, between the parts of the fold line 61 extending on either side thereof. The wall 89 is also somewhat longer in the direction of the fold line 61 than the wall 86, so that the wall 89 cannot work its way upwardly through the aperture 85. Thus, the walls 87 and 88 are actually flared somewhat outwardly with respect to the center of the top panel 16 as shown in FIG. 7**.

Figure 2:
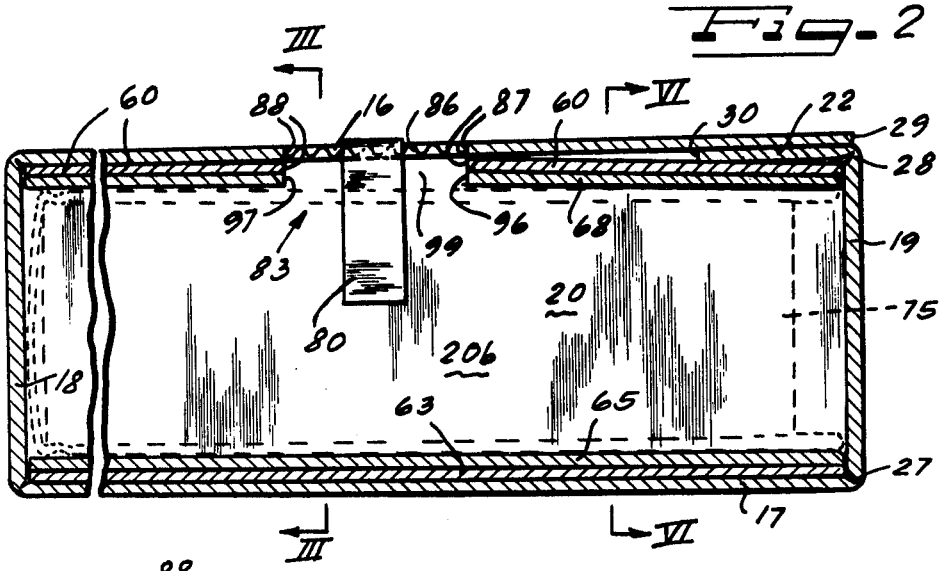
FIG. 2 is an endwise sectional view through two reinforced end edges of the container, taken on line II—II of FIG. 1.

The second outer reinforcing member 70 is also formed with a recess structure or notch 95 adapted for forming the tape recess 83 upon assembling the box or carton 15 as in FIG. 1. The tape notch 95 is formed by opposite walls 96 and 97 which are transverse to the fold lines 66, 67, and 69 of the outer end flap 56. A third wall 98 of the recess 95 is formed parallel to the fold lines and slightly outwardly of the fold line 69 toward the free edge 70 of the second, outer reinforcing member 68. The wall 98 forms an extension of the outer end flap **20*b*, comprising a tape flap 99 which extends upwardly to the level of the wall 89 of the tape aperture 85. The tape flap 99 is somewhat wider than the wall 86 at the rear of the recess 85 to abut an undersurface of the top panel 16 at rounded corners 100 of the recess 85 therein. The walls 96 and 97 are spaced apart and oriented to underlie the walls 87, 88 of the aperture 85 as shown in FIG. 2. All outwardly projecting corners 101, 102, 103, and 104 of the aperture 85 and the recess 95** are rounded to resist snagging or other damage thereto and to improve the finished appearance of the carton.

Figure 8:
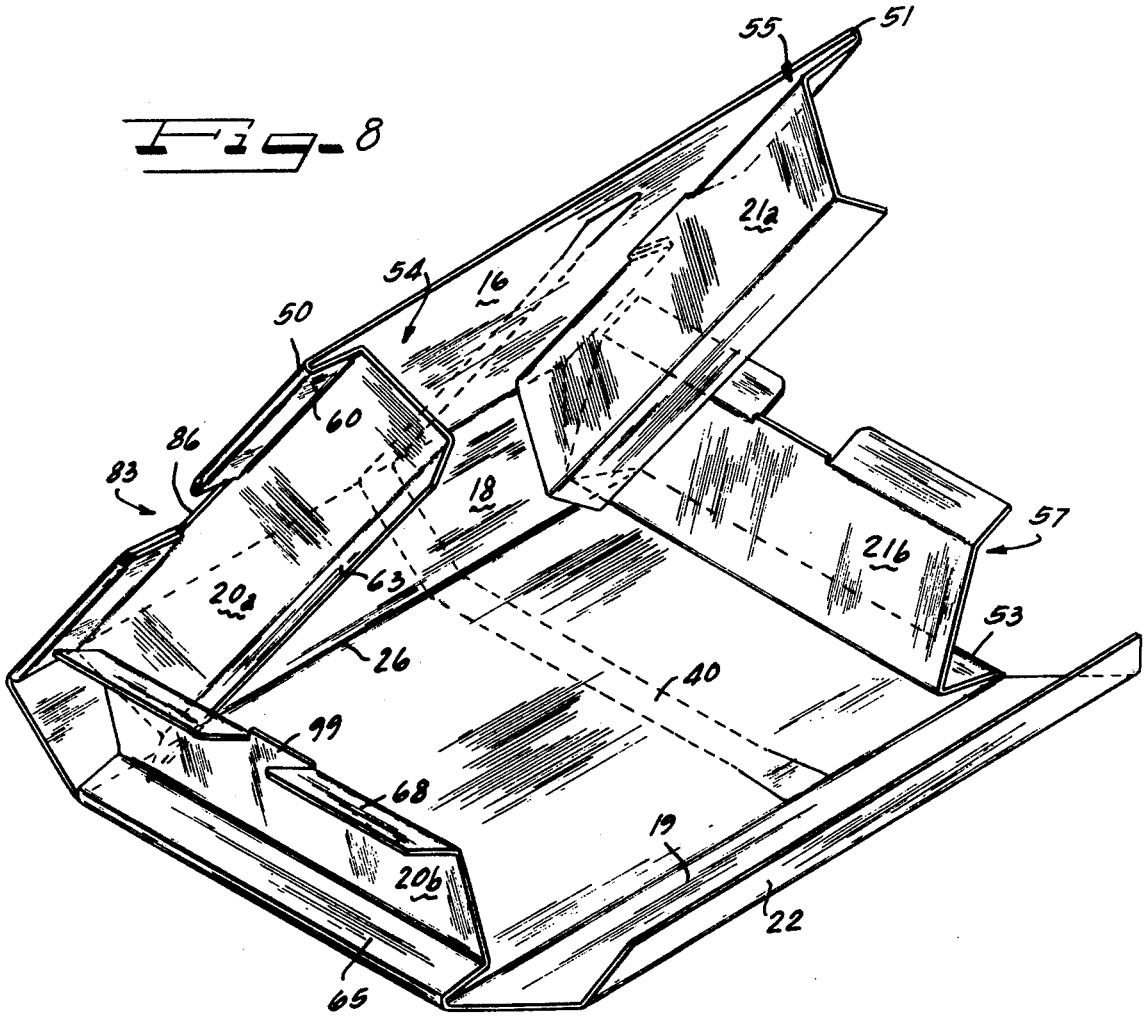
FIG. 8 is a perspective view of the blank of FIG. 7 during an early assembly stage thereof.

In use, the mailing carton 15 is assembled from the sheet form blank 77 of FIG. 7 which has been cut and scored to a desired shape and size for panels 16, 17, 18, 19, 20, and 21. Normally blanks as shown in FIG. 7 will be provided to a customer in flat form to conserve shipping and storage space. Once a blank is needed for assembly, the first side panel 18 and the top panel 16 are folded respectively on lines 26 and 25 from the bottom panel 17. As shown in FIG. 8, the end panels 54–57 may also be folded upwardly and inwardly, with the first inner reinforcement members 60 folded flat against the undersurface of the top panel 16 and the second inner reinforcing member 63 extending between the bottom panel 17 and the first outer reinforcement member 65 of the end flap 56.

Figure 9:
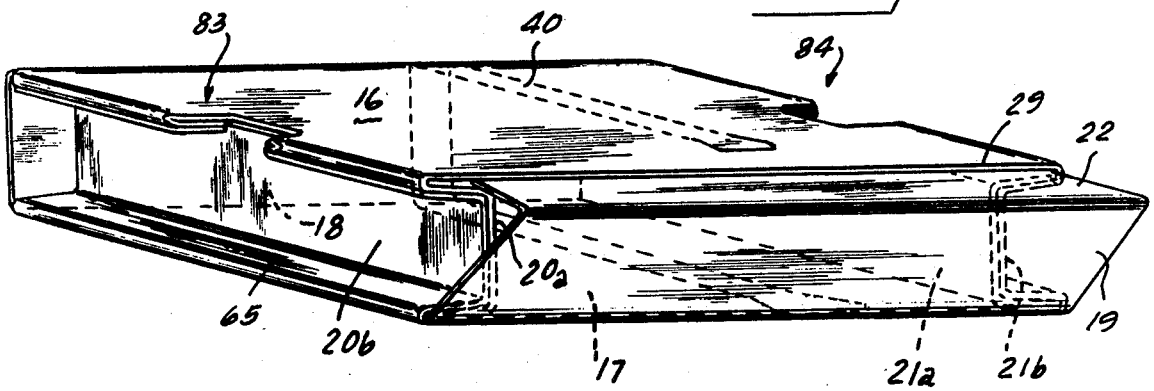
FIG. 9 is a further perspective view of the blank of FIGS. 7 and 8, before final insertion of the flap into engagement with the top panel.

Once the top and bottom panels 16 and 17 have been placed in parallel relationship to one another, forcing the outer end flap 56 into the end recess with the second outer reinforcing member 68 against the first inner reinforcing member 60 and with the tape flap 99 abutting against the wall 86 of the tape recess 83, in the manner of FIG. 9, the carton 15 will substantially hold its own shape. Application of the tape segments 80, 81 is then accomplished, prior to loading the carton 15 with one or more books 75.

As a final operation, the flap tab 22 is tucked between the undersurface of the top panel 15 and the first reinforcement members 60. An upper surface of the flap tab 22 may be coated with an adhesive material to be activitated by heat or pressure once fully inserted with the wall 19 parallel to the opposite side wall 18. Alternatively, the flap tab 22 could be sealed atop the panel 16.

The carton 15 thus formed has three layers of corrugated material protecting each top and bottom end edge of the space within the carton, helping to insure that the contents of the carton will not be damaged upon rough handling during shipment.

Although various minor modifications will be apparent to those skilled in the art, it should be understood that I wish to embody within the scope of the patent warranted hereon all such modifications as reasonably and properly come within the scope of my contribution to the art.

I claim as my invention:

1. A mailing carton comprising:

a one-piece blank of paperboard stock having spaced flat sides separated by corrugations to form inside and outside surfaces of the carton, said blank having a main top wall panel and a main bottom wall panel each having opposite end edges and sides, a first side wall panel between the top and bottom panels, and a second side wall panel adjacent a side of one of said main top and bottom panels, each of said main panels having at each of its opposite ends a three-panelled end flap including a major, centrally disposed end wall panel flanked by two minor reinforcement panels extending parallel to the ends of the main panel, one of said minor panels of each end flap adjoining the main panel and another lying opposite said end wall panel therefrom, each end edge of one of said main panels and each of the minor reinforcement panels adjoining same being notched in register with one another to form a recess and each of the minor reinforcement panels to the end flaps opposite the other of said main panels also being recessed to register with said recess in the assembled carton, whereby in assembled form there is provided triple thickness corners and double thickness end walls to protect the contents of the carton, said recess accommodating an L-shaped sealer machine for application of a sealing tape to the right angle surfaces at a junction of the top wall and the end walls.

2. A mailing carton formed of a sheet material, the carton comprising:

parallel top and bottom panels each having side edges and end edges;

two parallel side walls extending between the top and bottom panels at and transversely to said side edges thereof;

inner and outer end flaps extending inwardly of and between adjacent edges of the top and bottom panels, each said end flap comprising two reinforcement portions and one end wall portion therebetween, said reinforcement portions extending parallel to the top and bottom panels and spacing said end wall portions inwardly of said end edges of said top and bottom panels, and wherein the top panel at an end edge portion thereof and two adjoining reinforcement portions of the end flaps are formed with cut-out portions to the depth of the end wall recess, leaving a right-angle bend between an upper surface of the top panel and an outer surface of the end flaps, whereby to reinforce and to rigidify the end edges of the top and bottom panels of said carton with triple thicknesses of material and to form recessed, double-thickness end walls therefor, and whereby an adhesive tape may be applied in an "L"-shape between the top panel and the outer end flap at each end of the carton.

3. A mailing carton formed from corrugated sheet stock and comprising:

a rectangular top panel having transverse side and end edges;

a rectangular bottom panel opposite said top panel and having corresponding side and end edges;

a rectangular first side panel joining the top and bottom panels by folds formed along two side edges thereof;

a rectangular second side panel joined to one of the bottom and top panels opposite the first side panel at a side edge line and carrying opposite said side edge fold line a side tab adapted to engage a surface of one of the top and bottom panels;

a pair or inner end flaps joined to said top panel at either end edge thereof, each said inner end flap comprising a first inner reinforcing member, an inner flap member, and a second inner reinforcing member all joined sequentially to each other from one of said end edges of the top panel, and the first and second reinforcing members being adapted to extend parallel to the top panel and the inner flap member to extend transversely thereto and inwardly of the top panel end edge;

a pair of outer end flaps joined to said bottom panel at either end thereof;

each said outer end flap comprising a first outer reinforcing member, an outer flap member, and a second outer reinforcing member all joined sequentially to each other from one of said end edges of the bottom panel, the first and second outer reinforcing members extending parallel to the bottom panel and overlying the respective inner reinforcing members;

surfaces forming a tape hole across and through each of said first inner reinforcing members and in adjoining portions of the top panel, each tape hole extending inwardly of the end edge of the top panel a distance less than that of a width of the first inner reinforcing member; and surfaces forming a tape notch in each said second outer reinforcing member and extending substantially the width thereof, whereby the carton has triple-thickness, reinforced top and bottom panel end edges and is adapted to be sealed by a short piece of tape applied in an L-form between the top panel and the outer end flap members.

4. A mailing carton as defined in claim 3, wherein said tape notch is formed by two spaced-apart cut lines extending in the sheet stock transversely of the end edge of the bottom panel and through the second outer reinforcing member and a fold line joining same to the outer end flap, and a third cut line extending between the two cut lines parallel with the end edge of the bottom panel and spaced outwardly from the bottom panel by substantially one thickness of the sheet stock beyond the fold line joining the second outer reinforcing member to the outer end flap, thereby to form a tape flap extending closely adjacent the tape hole in the top panel.

5. A mailing carton as defined in claim 4, wherein the width of the tape hole at a side thereof in the top panel in a direction parallel to the end edge of the top panel is less than that of the tape flap, and the widths of the tape flap and an opposite end of the tape hole on the fold line between the first inner reinforcement member and the inner flap member are substantially equal.

6. A mailing carton as defined in claim 3, wherein the first inner reinforcing member is folded to lie against an end edge of the top panel with the inner end flap member extending transversely thereto and the second inner reinforcing member folded to lie upon an end edge of the bottom panel; and wherein the first outer reinforcing member overlies the second inner reinforcing member, the outer end flap overlies the inner end flap member, and the second outer reinforcing member overlies the first inner reinforcing member, whereby to brace the ends of the carton with two vertical layers of sheet stock and with three horizontal layers of sheet stock at each of the top and bottom panels thereof.

7. A mailing carton as defined in claim 3, wherein the side flap tab is engaged between the first inner reinforcing member and the top panel on each end thereof and is adhered to said top panel.

8. A blank of corrugated, sheet-form material cut and scored for forming a mailing carton, the blank comprising:

four primary rectangular panels comprising top, bottom, and two side panels joined edgewise one to one another on first parallel fold lines and the top and bottom panels having end edges transverse to said fold lines;

four end flap panels each joined to one of the top and bottom panels along second fold lines at said end edges of said top and bottom panels, each said end flap panel comprising a first reinforcing member, an end flap, and a second reinforcing member in order outwardly from the end edges of the top and bottom panels, the reinforcing members being foldable into positions adjacent and parallel to said top and bottom panels adjacent the end edges thereof and wherein an aperture is formed through each end edge of the top panel and the adjacent first reinforcing member, the aperture having a depth transverse to the second fold lines approximately twice the width of the first reinforcement member and being centered on the top panel end edge; and wherein a notch is formed in the center of the second reinforcement member connected to the bottom panel, the notch being approximately equal in depth to the width of said second reinforcement member, whereby to provide a triple-thickness of sheet material on each end edge of the carton when assembled to resist shocks upon and damage to carton contents and surfaces permitting use of an L-shape tape segment to seal the carton upon assembly.

* * * * *